United States Patent [19]

Facchini

[11] 4,343,130

[45] Aug. 10, 1982

[54] CONTINUOUS MOVEMENT CAPSULE FILLING AND CLOSING MACHINE, PARTICULARLY FOR PACKAGING POWDER OR GRANULATED LOOSE PRODUCTS

[76] Inventor: Libero Facchini, Via Borgatti, 5, Bologna, Italy

[21] Appl. No.: 91,848

[22] Filed: Nov. 6, 1979

[30] Foreign Application Priority Data

Nov. 9, 1978 [IT] Italy ..... 3591 A/78

[51] Int. Cl.[3] ..... B65B 1/00; B65B 1/22

[52] U.S. Cl. ..... 53/272

[58] Field of Search ..... 53/529, 272, 281, 282, 53/381 R, 454; 198/400

[56] References Cited

U.S. PATENT DOCUMENTS

| | | | |
|---|---|---|---|
| 2,775,080 | 12/1956 | Stirn et al. | 53/454 X |
| 3,978,640 | 9/1976 | Crossley et al. | 53/282 X |
| 4,062,386 | 12/1977 | Zanasi | 53/281 X |

*Primary Examiner*—Horace M. Culver

*Attorney, Agent, or Firm*—Guido Modiano; Albert Josif

[57] ABSTRACT

A continuous movement capsule processing machine comprising, sequentially, a station for feeding empty capsules to be filled with a powder or granulated loose product, a capsule orienting station, a capsule opening station, a station for metering and loading the loose product into said capsules, and a station for closing and ejecting the loaded capsules. All stations are carried by a single turret set to revolve about a central drive axle and are recurrently arranged in each of a series of sectors of the turret located about the axle.

3 Claims, 10 Drawing Figures

Fig. 2
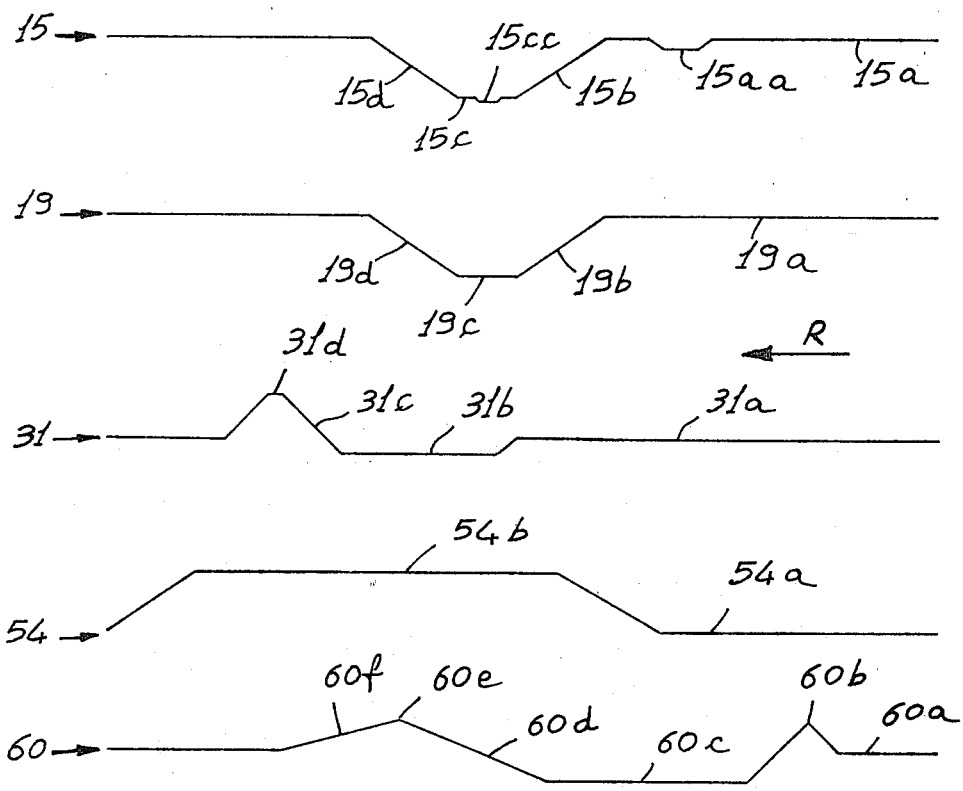
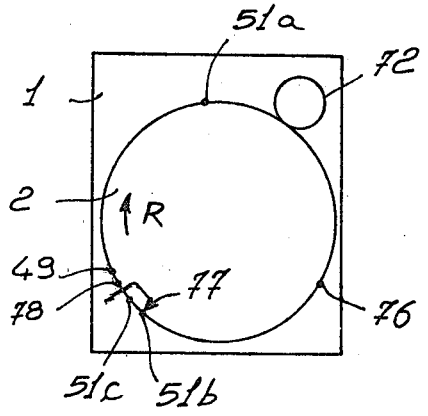
Fig. 10

CONTINUOUS MOVEMENT CAPSULE FILLING AND CLOSING MACHINE, PARTICULARLY FOR PACKAGING POWDER OR GRANULATED LOOSE PRODUCTS

BACKGROUND OF THE INVENTION

This invention relates to a continuous movement capsule filling and closing machine, particularly useful for packaging powder or granulated loose products.

In the field of capsule processing machines, i.e. machines adapted for filling capsules or opercles comprising a body or bowl portion and a cap portion, e.g. of hard gelatine, considerable technological progress has been gained in recent years.

Conventional reciprocating capsule processing machines comprise a plurality of discrete stations arranged along the periphery of a central table. Conventional continuous movement capsule processing machines comprise instead a plurality of rotating turrets, one for each operation whereto the capsules are to be subjected, i.e. one turret for feeding and orienting the capsules, one turret for separating the cap from the bowl of each capsule, one turret for metering out the loose product to be packaged and loading it into the bowl, one turret for joining a cap to a respective bowl, and one turret for closing the capsules and ejecting them out of the machine.

Some known capsule processing machines of more recent design only comprise two discrete turrets, one for the capsule feeding, orienting and transferring operations, and the other for opening the capsules, metering and loading the product into the capsules, closing the capsules and ejecting them from the machine.

However, conventional capsule processing machines have some drawbacks, among which are frequently occurring phase displacements resulting from incorrect alignment of the various stations or turrets. A proper alignment of the stations is, in turn, difficult to accomplish owing to the long processing distance which the capsules are to cover. Moreover, an adequate number of drive members or units must be provided between the various stations or turrets, which reflects in a considerably high noise level as well as high manufacturing cost.

SUMMARY OF THE INVENTION

This invention sets out to provide a continuous movement capsule processing machine, wherein all of the capsule handling and processing steps can be carried out.

Within that general aim, it is possible to arrange that said capsule processing machine is very compact in size and extremely quiet in operation.

It is further possible to arrange that the capsule processing machine of this invention has a much reduced path length for the capsules being processed therein, such as to optimize the machine output capacity, by virtue of the numerous downtimes required in conventional machines being eliminated.

It is further possible to arrange that the machine according to the invention can be easily and quickly adapted to a change in the size or format of the capsules to be processed.

According to one aspect of the present invention, there is provided a continuous movement capsule processing machine which comprises, sequentially, a station for feeding empty capsules to be filled with a powder or granulated loose product, a capsule orienting station, a capsule opening station, a station for metering and loading the loose product into said capsules, and a station for closing and ejecting the loaded capsules, characterized in that said stations are all carried by a single turret set to revolve about a central drive axle and are recurrently arranged in each of a series of sectors of said turret located about said axle.

DESCRIPTION OF THE PREFERRED EMBODIMENTS

A few embodiments of the continuous movement capsule processing machine according to the invention will be described hereinafter with reference to the accompanying drawings, where:

FIG. 2 shows schematically a plane development of five control cams of the machine of FIG. 1;

FIG. 10 is a schematical plan view of the machine of FIG. 1 showing the relative positions of some operational stations in the machine.

DESCRIPTION OF THE PREFERRED EMBODIMENTS

Figure 1:
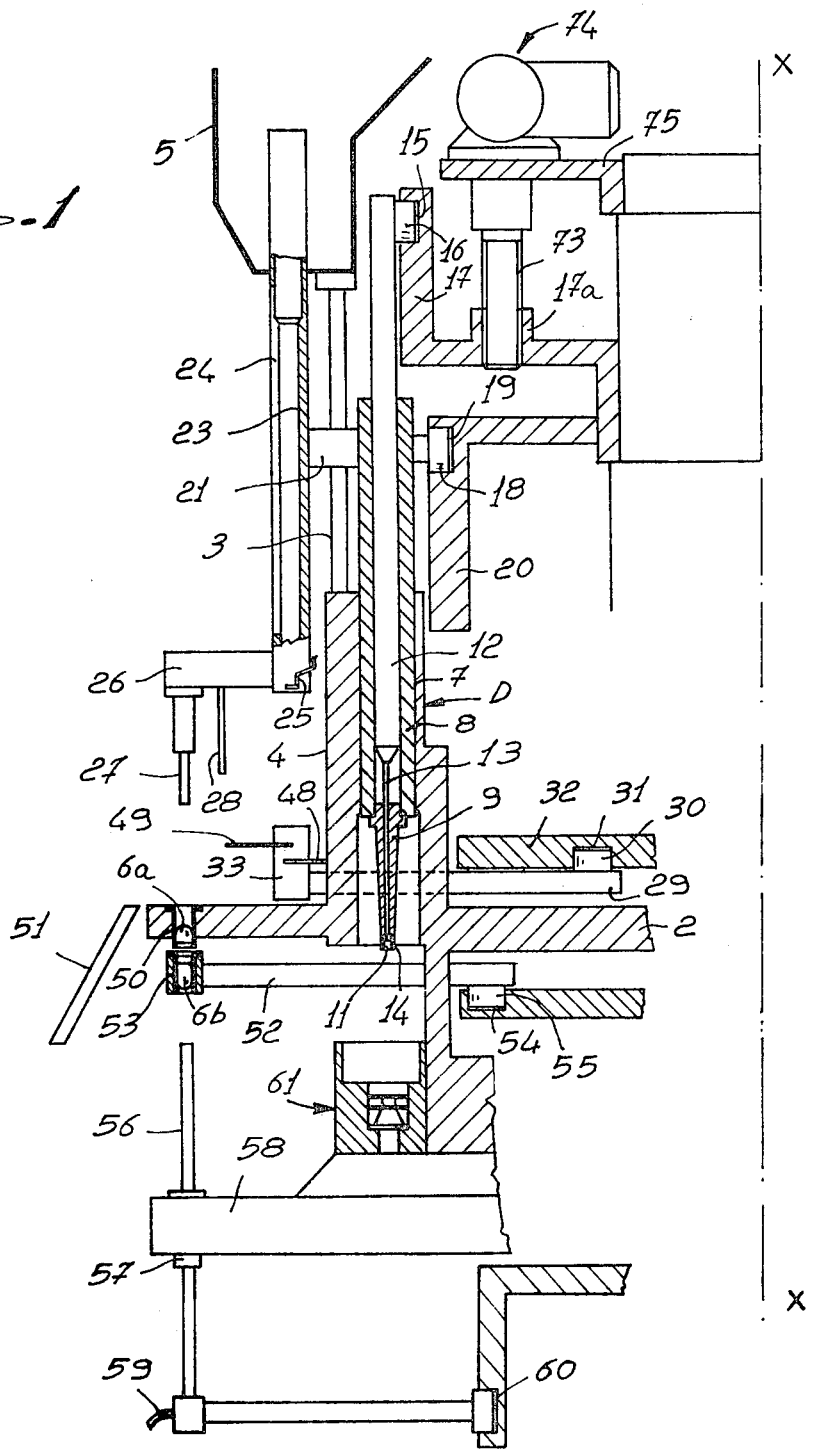
FIG. 1 is an elevational view of the machine, portions whereof are shown in diametrically vertical section.
Figure 7:
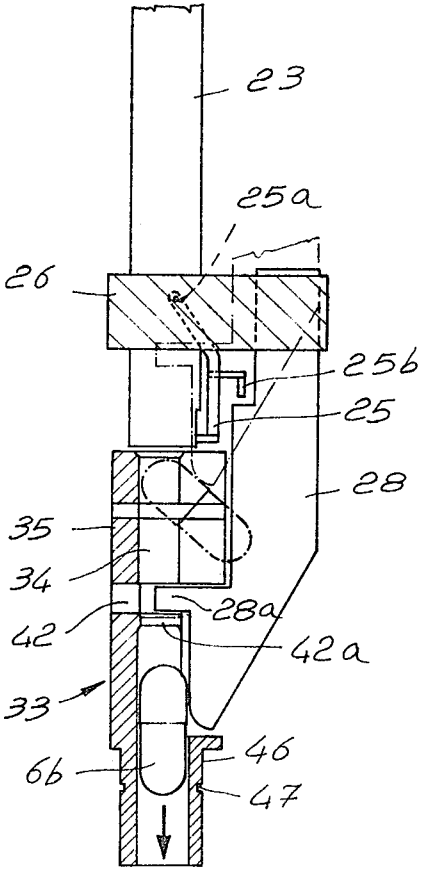
FIG. 7 is a vertical section through that same detail at a further stage of the machine operation.
Figure 3:
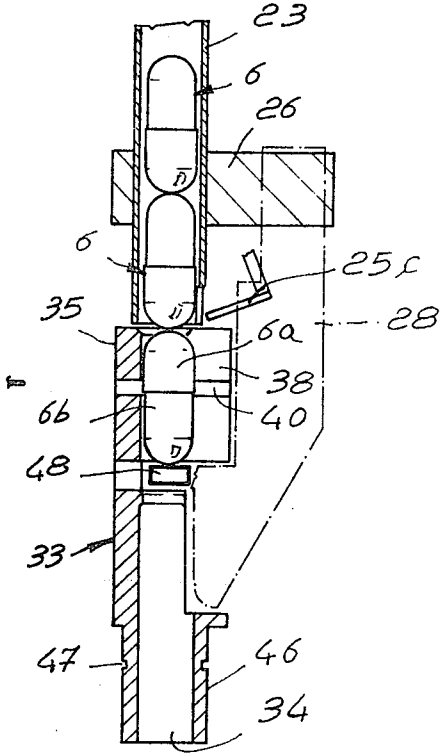
FIG. 3 is a vertical section elevational detail view of the capsule orienting station in the machine of FIG. 1.

With reference to the drawing figures listed above, the capsule processing machine shown therein comprises a supporting structure 1, whereon there is mounted a rotary platform 2 adapted for continuous rotation about a central vertical axis X—X. The platform 2 carries a plurality of capsule and/or product handling stations, said operative stations being actuated sequentially through the rotary movement of the platform 2, e.g. in the direction of the arrow R (FIGS. 2, 5 and 10) or clockwise when viewing the machine from above. Said plurality of operative stations are arranged, as shown in FIG. 1, on a vertical sector of the capsule processing machine, such that a number of such sectors can be provided to produce a multiple-sector machine; all of the machine sectors are structurally identical to one another and operated sequentially. Each sector on the platform 2 comprises an upright 3 rigid with the platform 2, whereto it is connected through an enlarged base 4. The upright 3 carries, at its top end, a rotating container 5 of large capacity for containing empty capsules 6. A vertical through bore 7 is formed in the base 4 and is adapted for slidably accommodating and guiding a cylinder 8 of a metering unit D. The cylinder 8 carries attached to its bottom end a hollow member 9 which protrudes coaxially beyond the cylinder 8 itself. The member 9 is drilled axially at 10 and is provided, at its bottom free end, with a seat 11, coaxial with the inner bore 10. Inside the cylinder 8, there is mounted slidably a stem element 12 which is terminated at the bottom with a sort of needle 13 penetrating the hollow member 9 and ending with the seat 11, where it carries a plunger 14. The top end of the stem 12 is operatively connected to a cam 15, e.g. through a roller 16, the cam 15 being formed on a structural element 17 which will be described hereinafter. The top end of the cylinder 8 is operatively connected, through the roller 18, to a cam 19 formed on a stationary structural element 20, and is also rigid, e.g. by means of a rigid union element 21, with a tube 23. The tube 23 penetrates with its top end the container 5 and has a longitudinal slit 24 for inspecting its inside. At its bottom end, the tube 23 has a journalled lever 25 (FIGS. 3, 5 and 7) for cutting off and controlling the flow of capsules 6 through the tube. For this purpose, the bottom end of the tube 23 carries an arm 26, whereto the (spring-loaded) lever 25 is journalled at 25*a* and to which there are attached a stem pusher 27 and a flattened pusher 28 (having a projecting raised portion 28*a*), both of which extend vertically downwards. The lever 25 is also provided with a lug or appendage 25*b* which can be engaged by a fixed detent (not shown) on the machine, as will be explained hereinafter.

Above the platform 2, there is arranged a cantilevered supporting arm 29 adapted for rotating with the turret 2–4; in that same turret, the arm 29 is guided slidably in a radial direction to the central axis X—X; thus, the arm is kinematically connected, through the roller 30, to a cam 31 formed on an element 32 rigid with the stationary supporting structure 1 of the machine. The arm 29 carries a shaped bushing element 33. As is more clearly visible in FIGS. 3 to 7, the bushing 33 has a substantially parallelepipedal body inside which a vertical calibrated passage 34 is defined for the capsules 6, which passage extends roughly coaxial with respect to the bushing. The bushing 33 has at its top end 35 an enlarged portion 36 in the shape of a cylindrical segment facing the axis X—X of the machine, the enlarged portion 36 defining a comparatively large flat surface 37 at the bushing top. The end 35 is also slit vertically along a slit 38 which reaches the passage 34 in communication therewith from the outside. The slit 38 is formed on the side 39 of the bushing body facing in the opposite direction to the direction of rotation R. The end 35 is also provided with a transversally extending horizontal groove 40 which, starting from the outer wall 41 opposite the enlarged portion 36, has a depth which goes farther than the passage 34 and extends across the full width of the bushing. Below the groove 40, at a distance related to the size of the capsules to be handled, the body of the bushing 33 is slit horizontally by the groove 42 which extends across that body of the wall 41 to the enlarged portion 36, while intersecting the passage 34. Below the groove 42, the passage 34 has a slightly necked portion 42*a*, which cannot be overcome by the cap 6*a* of a capsule 6 unless forced past it by pushing the capsule from above, as will be explained hereinafter. At its central portion 43, below the groove 42, the bushing 33 is cut in its side 39 along a vertical plane extending substantially along the centerline of the passage 34, thereby defining a depression 44 bordered at the top by the groove 42 and at the bottom by a horizontal abutment 45. The bottom end 46 of the bushing 33 is tubular and coaxial with the passage 34, and has an annular groove 47 for connection to the supporting arm 29. The bushing 33 is intended for cooperation with a detent element 48, rigid with the revolving turret 2–4 and adapted for slidably engaging the groove 42, and with a fixed detent element 49 rigid with the supporting structure 1 and adapted for slidably engaging the groove 40.

In the turret 2–4, in vertical alignment with each pusher 27 (FIG. 1), there is provided a seat 50 having a bottom which is open and shaped and/or calibrated, depending on the dimensions of the cap 6*a* of the capsules to be handled. Adjacent the path of the seats 50, and level with the platform 2, there are provided chutes 51 (more precisely, 51*a*, 51*b*, and 51*c*). which are carried, for conveying and removing the capsules, by the structure 1 at suitable angular positions (FIG. 10), as will be explained hereinafter. Directly below the platform 2, there is an arm 52 which carries a seat 53 intended for cooperation with a respective seat 50. The seat 53 has its bottom open and is shaped to accommodate the bowls 6*b* of the capsules to be handled. The arm 52 is driven rotatively with the turret 2–4 and caused to slide radially thereto by a fixed cam 54, which it engages through a roller 55. With the seat 53, at predetermined stages of the machine operation cycle, there cooperates a pusher 56 comprising a tube which is slidably carried at 57 by a disk 58 rigid with and underlying the platform 2. The tube 56 is in communication, at 59, with a vacuum source (not shown), and is controlled to perform vertically upward and downward movements by a fixed cam 60.

Figure 9:
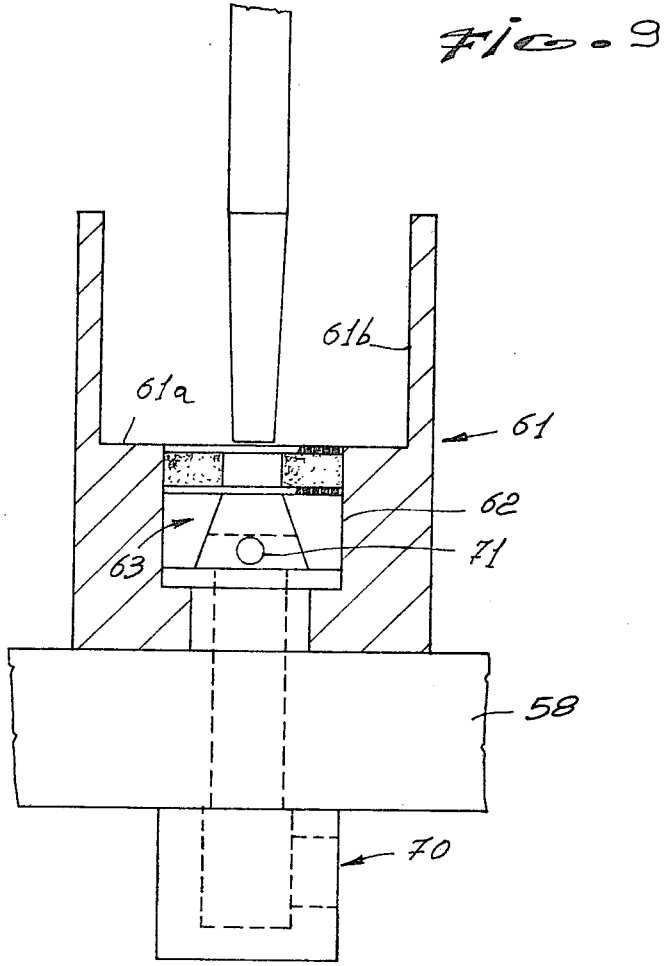
FIG. 9 is a view similar to FIG. 8, illustrating another embodiment of a metering station.
Figure 8:
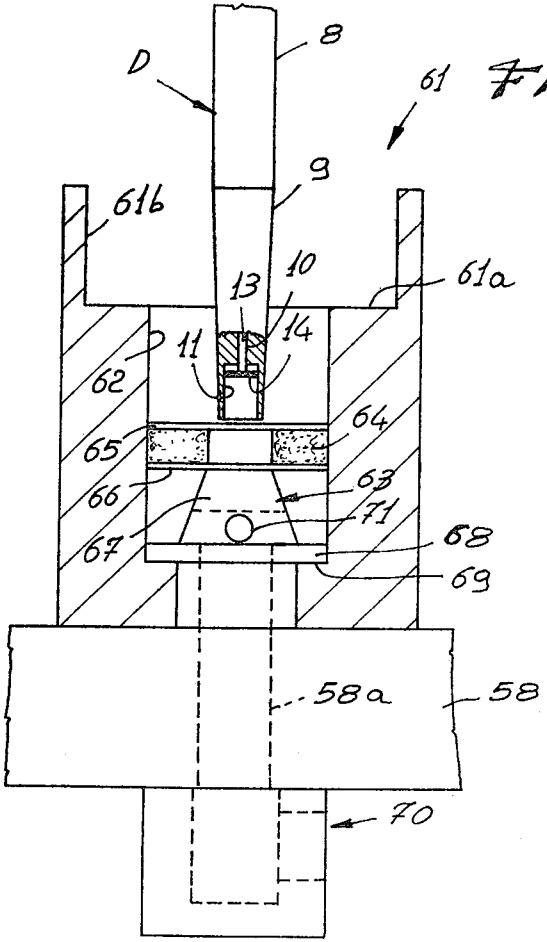
FIG. 8 is an elevational view, with portions in section, of a station for metering the product to be packaged.

Below the platform 2, and in vertical alignment with the base 4, there is provided a tank 61 for containing a powder and/or granulated product to be packaged. The tank 61, which is attached to the disk 58, rotates rigidly with the turret 2–4, and extends annularly around and coaxially with the axis X—X. Preferably, in the tank 61, a probe (not shown) is also provided to monitor the level of the product in the tank and control the machine to stop whenever the amount of product automatically fed to the tank 61 happens to be insufficient. In the embodiment shown in FIG. 8, at the bottom 61*a* of the tank 61, there are exposed the top of chambers 62, the axis of each chamber being aligned with the vertical axis of a respective metering device D. The lower portion of each chamber 62 is occupied by a removable bottom 63, which defines through its height the useful depth of the upper portion of the chamber 62. The bottom 63 comprises a porous layer 64 (either a felt element, or a sintered stainless steel one, or one including a web of a material known under the tradename of Teflon), which is held between two disks 65 and 66 perforated with a plurality of holes and formed from stainless steel. The disks 65 and 66 are affixed to a supporting or holding member 67, which extends downwards in the shape of a conical frustum and terminates at the bottom in a flange element 68 effective to abut against the bottom 69 of the chamber 62. The bottom 69 is open at a respective hole 58*a* through the disk 58, and is intended for communication, through a sector 70 fixedly attached to the structure 1, with a vacuum source (not shown). The vacuum can be applied to the product contained in the chamber 62, above the disk 65, by virtue of the member 67 being provided with holes 71 which communicates with the bottom 69, on one side, and with the bottom face of the disk 66, on the other side. Thus, the structure of the tank 61 allows the product to be packaged to be drawn into and compacted within the chambers 62 and above the disks 65, the product being withheld by suction during the picking up stage by the volumetric metering devices D. In the embodiment shown in FIG. 9, the disk 65 of the bottom 63 is in level with the bottom 61*a* of the tank 61, which constitutes in this case the product pick-up chamber as well. This embodiment is suitable for use with products which, thanks to their flowability, are already adapted per se to favor their compacting. This system of vacuum chambers affords the possibility of fully compacting a predetermined amount of the product, while eliminating the problem of pocket formation as due to uneven distribution and layering of the product, which problem would affect the accuracy of the metering provided by the metering devices. In fact, should the metering device in its downward stroke penetrate a non-compacted and homogeneous layer of product, it would pick up different amounts of the product dependent on the degree of stratification achieved by the product in the various areas of the tank. Moreover, a limited amount of the product (e.g. 1 kg.) will be sufficient in the tank and accordingly in the machine for processing, to achieve an accurate metering and consequently improved economy of the packaging process. The side walls 61*b* of the tank 61 are made relatively high in order to prevent spillage of product under the action of the centrifugal force which is developed during the continuous movement operation of the machine. The product in the tank 61 is constantly shaken and recycled after each pick-up by the metering devices D. From a fixed container 72 (FIG. 10), the product is conveyed, by means of an auger device (not shown), into a sliding distributor (not shown) which is equipped with levelling apparata. Beneath the sliding distributor, there is rotatively arranged the tank 61 which receives product in fixed amounts, the product being constantly shaved to remove any excess thereof. After moving past its respective metering device and after picking up a metered amount of product, each chamber 62 is directed to a recycling station (not shown), the recycling being carried out in counterflow by application of a slight pneumatic pressure to the chamber 62 through a fixed sector, similar to the sector 70. The product, after being detached and possibly suitably treated outside of the chamber 62, is re-introduced into the same. Each chamber 62, after the product detaching and feeding step, is now ready to again receive the metering device D, following re-application of suction by the sector 76.

In order to enable the amounts picked up by the metering devices D from the tank 61 to be changed, the machine further comprises (see FIG. 1) a device for simultaneously adjusting the depth of the seats 11. This device implies the mounting of the structural element 17, whereon the cam 15 is formed, for sliding, but not pivotal, movement along the axis X—X, said element defining a nut screw 17*a*, which is engaged by a micrometric screw 73 adapted to be rotated by a reversible electric motor-reducer 74, the motor-reducer being mounted on the fixed support 75 of the structure 1 and intended for receiving activating pulses either from manual operation of the machine controls or from an automatic system effective to statistically check the weight of the product in the capsules and self-regulate the machine. With this system, some of the capsules which (as will be explained hereinafter) have been filled and are ready for ejection and removal from the machine at the chute 51*c*, are instead removed, at present rates, at the chute 51*b* located directly upstream of the former. With this same system, the capsules from the chute 51*b* are then weighed on a digital scale, and the measured weight is then compared with a nominal or reference value preset in a computer, thereafter the deviations between the measured weight and nominal weight are converted into proportional activating pulses for the motor-reducer 74.

The vertical profiles of the cams 15 and 19 (FIGS. 1 and 2) are almost identical and in the same phase; thus, after a certain distance has been established through the motor-reducer 74 between the cam 15 and cam 19, the stem 12 and plunger 14, and the cylinder 8 and hollow member 9 are mostly rigid with each other, both during the upward and downward strokes (lengths 15*b*–19*b* and 15*d*–19*a* of the cams 15 and 19) and during the residence in the high position (FIG. 1) and low position (FIGS. 3–9), which positions are respectively corresponding to the lengths 15*a*–19*a* and 15*c*–19*c* of the cams and wherein the body 9 overlies the level of the seat 53 and is adjacent the disk 65 of the respective chamber 62. However, in actual practice, as the member 9 reaches the low position and the seat 11 is filled with its metered amount of product, this metered amount is compressed by the plunger 14 which, inside the seat 11, moves to a slightly lower level (length 15*cc*), to then return to its original level prior to the member 9 and plunger moving upwards together to bring the compressed metered amount to the high position. It is expedient that the degree of compression of the metered amount of product be made adjustable in proportion to the capacities of the seats 11 and according to the nature of the product to be packaged. Thus, it is provided for the length 15*cc* of the cam 15 to be a movable element connected to the length or portion 15*c* by means of a linkage and controlled to raise and drop similarly to the cam 15 as a whole. Even as the member 9 reaches the high position and beneath it the seat 53 is presented (length 54*a* of the cam 54), the plunger 14 is lowered into the seat 11 almost to the level of the mouth thereof (length or portion 15*aa*), thus accomplishing the ejection of the compressed metered amount from the seat 11 and the introduction thereof into the bowl 6*b* of a capsule located in the seat 53. Actually, there could be no bowl 6*b* present in the seat 53; therefore, the seat is subjected to a downwardly directed suction action by a fixed sector 76 which, in the absence of a bowl and to keep the seat clean, provides for the removal of the metered amount and the discharge of the same through the open bottom of the seat 53.

Figure 5:
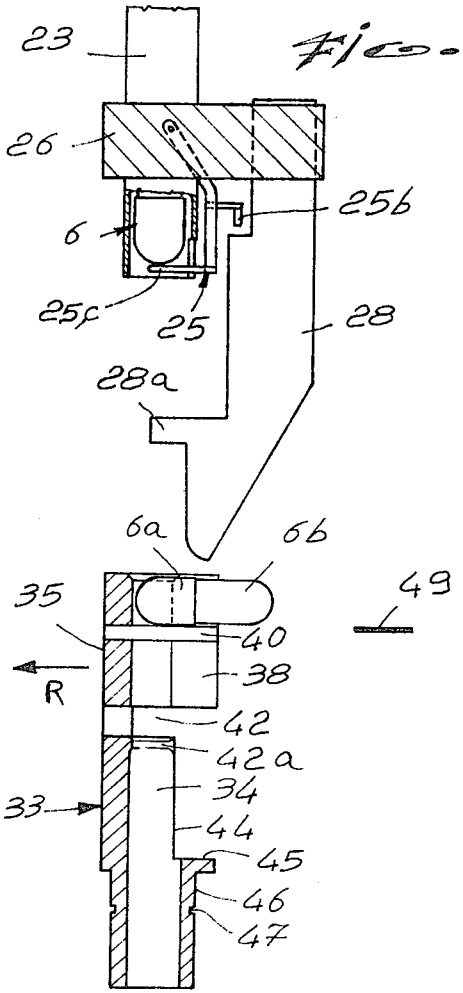
FIGS. 5 and 6 are similar detail views at a subsequent stage, respectively shown in vertical section and in perspective.
Figure 6:
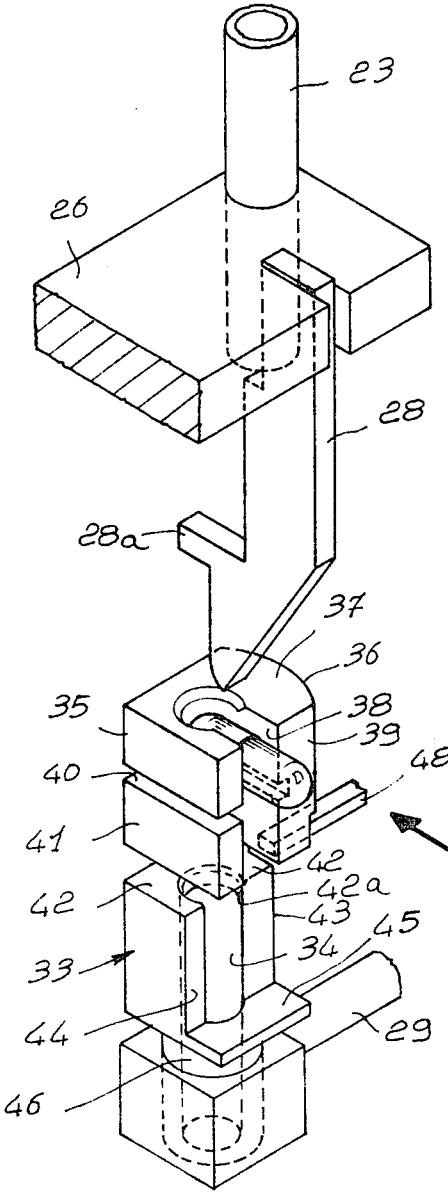
Figure 4:
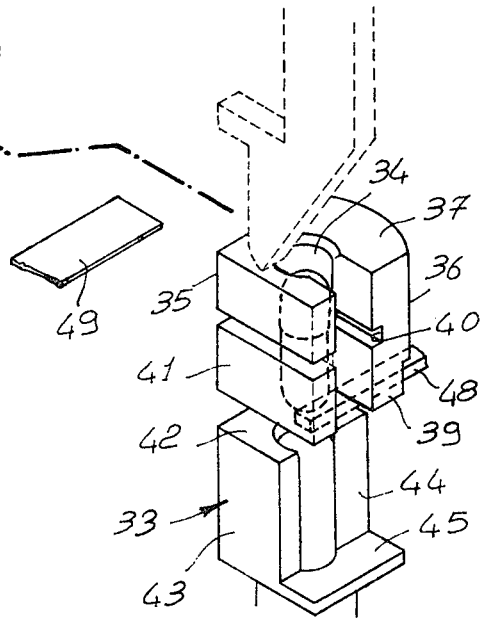
FIG. 4 is a perspective detail view of FIG. 3 at a successive stage of the machine operation.

The general operation of the machine just described will be next reviewed, after explaining the schematic representations of the developed cams 15,19,31,54 and 60 shown in FIG. 2. Such developed patterns, which are shown in suitable mutual phase relationships, provide an indication of the vertical and horizontal displacements which the cams impart to the members controlled thereby; thus, the high and low spots in the developments of the vertical cams 15, 19 and 60 are directly related to reality; the high and low spots in the developments of the horizontal cams 31 and 54 correspond instead to the conditions where the arms 29 and 52 are respectively shifted outwards and inwards with respect to the central axis X—X. Now, it is about this axis that the turret 2–4 is rotated continuously in the direction R; thanks to said cams, the operative stations of each sector in the turret perform sequentially the following operations, which are then performed in the same order also by the stations in the following sectors. As the metering device D and tube 23 (lengths or portions 15*d*–19*d*) are controlled to reach the high position, the metering device carries therealong a metered amount of the product and the tube, by penetrating the container 5, is enabled to load itself with capsules 6, which run downwards inside the tube to form a column retained at the lower end of the tube by the lever 25. The bottom or lowermost capsule in the column can present downwards the cap 6*a* and bowl 6*b*, and from the previous cycle, may be resting on the upturned portion 25*c* of the lever 25 (FIG. 5) or be merely clamped thereby, as that portion could not fully penetrate the tube 23 because that same capsule was partly protruding beneath the tube. After the tube 23 has been loaded with capsules and the metering device D has unloaded its charge of product, they both complete the downward stroke (lengths or portions 15*b*–19*b*); at a position underlying the bottom or lower end of the tube, there is located the flat surface 37 of the enlarged portion 36 of the respective bushing 33; the bushing is in fact located at an intermediate position (length or portion 31*a* of the cam 31), between the innermost position and the outermost one (respectively, lengths or portions 31*b* and 31*d*) with respect to the axis X—X. Any capsule which might protrude beneath the tube is caused to re-enter the same and abut against the surface 37; short before the downward stroke of the tube 23 is completed, the lug 25*b* of the lever 25 engages with a fixed detent, thereby the upturned portion 25*c* leaves its position of retention of the capsule, which capsule being located at the bottom of the tube 23 is presently caused to rest upon the surface 37. Then the bushing 33 reaches its inner position (length or portion 31*b*), whereat the passage 34 is coaxial with the tube 23 and the capsule, being located at the bottom of the latter, is dropped into the bushing and caused to rest onto the detent 48, which (FIGS. 3 and 4) is engaging the groove 42. Whilst the down residence of the metering device D (which has picked up product from the tank 61) and tube 23 comes to an end, the lug 25*b* of the lever 25 disengages from said fixed detent and the upturned portion 25*c* of the lever, by virtue of the return spring, moves back into its position of retention of the column of capsules in the tube 23. Then the bushing 33 is moved (length or portion 31*c*) from its inner position to the outer one; during the initial stage of this movement, the groove 40 is crossed by a fixed detent 49 which engages the capsule arranged vertically in the passage 34 and still retained by the detent 48. The detent 49 tilts the capsule over and turns it upwards or downwards such as to dispose it horizontally, respectively above or below the groove 40; the rotation in one direction or the other occurs depending on whether the capsule has been started along the passage 34 with its bowl 6*b* or cap 6*a* facing downwards, and results, as is well known, from the fact that the cap 6*a*, having a larger diameter than the bowl 6*b*, meets a higher resistance than the bowl in penetrating the slot 38. The slot 38 has in fact a slightly smaller width than the diameter of the bowl 6*b*, thereby the capsule, once disposed horizontally, remains slightly clamped in that same slit (FIGS. 5 and 6). When disposed horizontally, the capsule has its cap substantially inside the passage 34, and its bowl protruding out of the slit 38. It should be noted that, different from conventional capsule packaging machines, the capsule, as horizontally oriented, is also arranged tangentially with respect to the circular motion of the turret 2–4, thus being relieved of the undesired effects of the centrifugal force due to that same motion, such as are instead encountered when the capsule is disposed radially to the motion.

After a short residence (length 31*d*) in the outer position, the bushing 33 is returned to its middle position (length 31*a*), whereat the passage 34 is not yet engaged by the detent 48. With the bushing in this position (FIG. 6), the tube 23 and pushers 27 and 28 rigid therewith are lowered as mentioned; the lower tip of the pusher 28 penetrates the slit 38 and engages the capsule, being disposed horizontal with respect to one or the other level, to cause it to turn downwards (FIG. 7), and then again introduces it vertically into the passage 34; this time, however, the vertically arranged or upright capsule has its bowl 6*b* positively oriented downwards. The cap 6*a* of the capsule, which has possibly abutted against or has been slightly clamped in the neck 42*a*, is reached by the raised portion 28*a* of the pusher 28 with vertical orientation. The push applied by the raised portion 28*a* intersecting the passage 34, forces the capsule to move past the neck, and owing to the presence of the tip of the pusher 28, the capsule is prevented from moving out of the portion of the passage 34 which corresponds to the depression 44 and fall accordingly within the tubular end 46, at the bottom of the bushing 33; the capsule remains resting on the rim of the platform 2, whereat the seats 50 are located. The capsule is thus introduced positively into the tubular end 46 in a very simple manner and notwithstanding phenomena of an electrostatic nature which may tend to cause the capsule to adhere to the orientation bushing 33. Upon completion of the vertical orientation of the capsule, the raised portion 28*a* (FIG. 7) is located at the groove 42, whereof it moves out to bring the bushing to the inner position (length or portion 31*b*) and under the tube 23, as mentioned hereinabove. It should be noted that the bushing 33 can be of very simple construction, which results in lower production costs and easier preparation of bushing sets to meet the size requirements of the various capsules. Moreover, the change of size is relatively simple and quick in the inventive machine: it is sufficient that the bushings, seats 50 and 53, bodies 9, needles 13 and related plungers 14 be changed, and that the metering devices D are duly adjusted.

It can be observed that, at each revolution of the turret 2–4, each sector in the machine is enabled to orient one capsule with its bowl downwards, which at the successive revolution, as indicated hereinafter, that same sector will then fill and eject from the machine; on the other hand, during one revolution, each sector of the machine is enabled to fill and eject that capsule which, during the previous revolution, had been oriented with its bowl downwards. In fact, as the bushing 33 reaches its outer position (length 31*d*), the oriented capsule, which is inside the tubular end 46, is coaxial with a respective seat 50 and respective seat 53, which is correspondingly at rest in its outer position (length 54*b* of the cam 54). Thus, the capsule is allowed to drop into the seat 50 and forced to open such that its cap remains in that same seat 50 while its bowl drops into the underlying seat 53. During this stage, the tube 23 and pusher 27 are in the high position, whilst the lower pusher 56 has just reached an intermediate level thereof, slightly below the seat 53 and corresponding to the length or portion 60*a* of the cam 60. The capsule dropping and opening operations are favored and determined by the application, through the tube 56, of a downward suction action and application, to the top of the seat 50, of an air blow supplied by a nozzle attached to the structure 1 (not shown): in this stage, the bushing 33 has in fact moved to its intermediate position (length 31*a*) below the pusher 28. Upon completion of the capsule opening and dismantling stage, the seat 53 reaches the inner position (length 54*a*) in order for the bowl 6*b* contained therein to receive the metered amount from the metering device D, as indicated. In the meantime, the pusher 56 quickly completes an upward stroke up to a maximum level (point 60*b* of the cam 60), whereat the top of the pusher is inside the seat 50 (without displacing any cap 6*a* which may be therein; if, by contrast, for a malfunction whatever, an unopened capsule has remained in the seat, that capsule will be ejected and removed through the chute 51*a*. Thereafter, and just as quickly, the pusher 56 moves down to a minimum level (length 60*c*) and in the meantime the seat 53, which is on the point of returning to its outer position, is subjected to the action of an underlying suction-applying sector 76, for the possible removal of any metered amount which might have found no bowl 6*b* to receive it. While the seat 53 is on the point of resuming its position of alignment with the seat 50, the metering device D, tube 23 and pushers 27,28 move to the low position. Thus, upon alignment of the seat 53 with the seat 50, the pusher 56 performs a slow upward stroke movement (length 60*d*) up to the previous maximum level (point 60*e*); the filled bowl 6*b* is thus raised to contact the cap 6*a* and the assembly including both of them is then compressed to close the capsule, between that same pusher 56 and overlying pusher 27, which is also moving upwards (length 19*d*) towards the high position. After making opposition for the closing of the capsule, the pusher 27 moves upwards faster than the pusher 56, thereby at the chute 51*b*, the capsule has already been released by the pusher 27, but is still retained on the pusher 56, which subjects it to suction. If the capsule packaging machine is subjected to said statistical weight check of the product in the capsules, and the capsule is to be removed through the chute 51*b* for delivery to said digital scale, then, upon a pulse from said computer, a nozzle 77, attached to the structure 1, will cause an air jet to impinge on the capsule by directing it towards the chute 51*b*. The normal delivery of the filled capsules occurs instead through the chute 51*c*, whereat the pusher 56 reaches its maximum level and applies no suction to the capsule. As soon as the filled capsules leave the machine and the pusher 56 moves slowly downwards again (length 60*f*), the seats 50 and 53 reach below a fixed suction sector 78 which cleans the seats themselves, the bushing 33 being still away from its outer position.

The machine described hereinabove is susceptible to many modifications and variations, all of which fall within the purview and scope of this invention.

I claim:

1. A capsule filling machine for filling capsules comprising a bowl portion and a cap portion with powder or granulated loose product, said machine including a turret which is continuously rotatable about a vertical axis and is formed by a plurality of sectors each comprising a station for feeding empty capsules to be filled from a container in which the capsules are randomly oriented, in closed condition, a capsule orienting station, a station for metering and loading the product into said capsules and a station for opening, closing and ejecting the loaded capsules, wherein said orienting station comprises a bushing element defining a vertical calibrated passage therein for the capsules and having a longitudinal slit and transversal upper groove and transversal lower groove intersecting said passage and said longitudinal slit, the bushing element being adapted, during operation, to slidably engage sequentially a first detent, which is adapted for penetrating the lower transversal groove to stop the downward movement of a capsule fed into the bushing element, and a second detent which is operative to penetrate the upper transversal groove and tilt the capsule over, as stopped by the first detent, by turning it upwards or downwards, in order to orient it horizontally and arrange it with its cap inside said inner passage and its bowl protruding from said longitudinal slit.

2. A machine according to claim 1, wherein said bushing element, being movable along a respective radius in said revolving turret, has said slit open in a plane perpendicular to said radius, whereby the capsule, as oriented horizontally in the bushing element, is disposed tangentially with respect to the rotary motion of said turret.

3. A machine according to claim 1 wherein said bushing has a neck in said passage below said lower transversal groove and a tubular portion terminating the lower portion of said passage and cooperating with a pusher operative to repel into said passage the horizontally oriented capsule and force it past said neck and introduce it positively into said terminating portion.

* * * * *